US010339938B2

(12) United States Patent
Gao

(10) Patent No.: US 10,339,938 B2
(45) Date of Patent: Jul. 2, 2019

(54) SPECTRUM FLATNESS CONTROL FOR BANDWIDTH EXTENSION

(71) Applicant: HUAWEI TECHNOLOGIES CO., LTD., Shenzhen, Guangdong (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 42 days.

(21) Appl. No.: 14/719,693

(22) Filed: May 22, 2015

(65) Prior Publication Data

US 2015/0255073 A1 Sep. 10, 2015

Related U.S. Application Data

(63) Continuation of application No. 13/185,163, filed on Jul. 18, 2011, now Pat. No. 9,047,875.

(Continued)

(51) Int. Cl.

*G10L 19/24* (2013.01)
*G10L 19/26* (2013.01)

(Continued)

(52) U.S. Cl.

CPC ..... *G10L 19/002* (2013.01); *G10L 19/022* (2013.01); *G10L 19/24* (2013.01);

(Continued)

(58) Field of Classification Search

CPC ..... G10L 19/26; G10L 19/02; G10L 19/04
See application file for complete search history.

(56) References Cited

U.S. PATENT DOCUMENTS 5,778,335 A * 7/1998 Ubale ..... G10H 1/125 704/219
6,708,145 B1 * 3/2004 Liljeryd ..... G10L 21/038 704/200.1

(Continued)

FOREIGN PATENT DOCUMENTS

CN 1918634 A 2/2007
EP 1439524 A1 7/2004

(Continued)

OTHER PUBLICATIONS

Mehrotra, Sanjeev, et al. "Hybrid low bitrate audio coding using adaptive gain shape vector quantization." Multimedia Signal Processing, 2008 IEEE 10th Workshop on. IEEE, 2008.*

(Continued)

*Primary Examiner* — Matthew H Baker
(74) *Attorney, Agent, or Firm* — Fish & Richardson P.C.

(57) ABSTRACT

In accordance with an embodiment, a method of decoding an encoded audio bitstream at a decoder includes receiving the audio bitstream, decoding a low band bitstream of the audio bitstream to get low band coefficients in a frequency domain, and copying a plurality of the low band coefficients to a high frequency band location to generate high band coefficients. The method further includes processing the high band coefficients to form processed high band coefficients. Processing includes modifying an energy envelope of the high band coefficients by multiplying modification gains to flatten or smooth the high band coefficients, and applying a received spectral envelope decoded from the received audio bitstream to the high band coefficients. The low band coefficients and the processed high band coefficients are then inverse-transformed to the time domain to obtain a time domain output signal.

16 Claims, 6 Drawing Sheets

Filter Bank Decoder with SBR, Spectrum Flatness Control and Optional Post-processing

Related U.S. Application Data

(60) Provisional application No. 61/365,456, filed on Jul. 19, 2010.

(51) Int. Cl.

| | |
|---|---|
| ***G10L 25/18*** | (2013.01) |
| ***G10L 19/002*** | (2013.01) |
| ***G10L 19/022*** | (2013.01) |
| ***G10L 21/038*** | (2013.01) |
| ***G10L 21/0388*** | (2013.01) |

(52) U.S. Cl.

CPC ..... *G10L 19/26* (2013.01); *G10L 21/038* (2013.01); *G10L 21/0388* (2013.01); *G10L 25/18* (2013.01)

(56) References Cited

U.S. PATENT DOCUMENTS

| | | | | |
|---|---|---|---|---|
| 6,978,236 | B1 * | 12/2005 | Liljeryd | G10L 19/0208 704/200 |
| 7,379,866 | B2 | 5/2008 | Gao | |
| 7,941,319 | B2 * | 5/2011 | Nomura | G10L 21/038 704/500 |
| 8,326,641 | B2 * | 12/2012 | Song | G10L 19/0204 704/500 |
| 8,463,602 | B2 | 6/2013 | Oshikiri | |
| 8,468,025 | B2 * | 6/2013 | Liu | G10L 19/0208 704/200 |
| 8,527,283 | B2 * | 9/2013 | Jasiuk | G10L 21/038 704/205 |
| 8,532,983 | B2 * | 9/2013 | Gao | G10L 21/038 704/200 |
| 8,560,304 | B2 * | 10/2013 | Choo | G10L 21/038 381/23 |
| 8,571,852 | B2 * | 10/2013 | Bruhn | G10L 19/26 375/240.11 |
| 8,793,126 | B2 * | 7/2014 | Gao | G10L 19/26 704/228 |
| 8,831,958 | B2 * | 9/2014 | Lee | G10L 19/025 704/216 |
| 2003/0004711 | A1 | 1/2003 | Koishida et al. | |
| 2005/0065792 | A1 | 3/2005 | Gao | |
| 2007/0219785 | A1 * | 9/2007 | Gao | G10L 19/26 704/200.1 |
| 2007/0238415 | A1 | 10/2007 | Sinha et al. | |
| 2008/0077411 | A1 * | 3/2008 | Takeya | G10L 19/005 704/500 |
| 2008/0195383 | A1 | 8/2008 | Shlomot et al. | |
| 2008/0260048 | A1 | 10/2008 | Oomen et al. | |
| 2009/0063158 | A1 | 3/2009 | Norden et al. | |
| 2009/0141790 | A1 | 6/2009 | Kawashima et al. | |
| 2009/0201983 | A1 * | 8/2009 | Jasiuk | G10L 21/038 375/240 |
| 2009/0222261 | A1 * | 9/2009 | Jung | G10L 19/24 704/219 |
| 2009/0240489 | A1 | 9/2009 | Aoyagi | |
| 2009/0259478 | A1 * | 10/2009 | Nomura | G10L 21/038 704/500 |
| 2009/0265167 | A1 * | 10/2009 | Ehara | G10L 19/265 704/219 |
| 2009/0271204 | A1 * | 10/2009 | Tammi | G10L 19/0208 704/500 |
| 2009/0306992 | A1 * | 12/2009 | Ragot | G10L 19/24 704/500 |
| 2010/0063802 | A1 * | 3/2010 | Gao | G10L 21/038 704/201 |
| 2010/0063803 | A1 * | 3/2010 | Gao | G10L 21/0364 704/205 |
| 2010/0063806 | A1 | 3/2010 | Gao | |
| 2010/0063808 | A1 | 3/2010 | Gao | |
| 2010/0063810 | A1 | 3/2010 | Gao | |
| 2010/0063811 | A1 | 3/2010 | Gao | |
| 2010/0063812 | A1 | 3/2010 | Gao | |
| 2010/0063827 | A1 | 3/2010 | Gao | |
| 2010/0070269 | A1 | 3/2010 | Gao | |
| 2010/0070270 | A1 | 3/2010 | Gao | |
| 2010/0169101 | A1 * | 7/2010 | Ashley | G10L 19/24 704/500 |
| 2010/0198587 | A1 * | 8/2010 | Ramabadran | G10L 19/06 704/205 |
| 2010/0262427 | A1 * | 10/2010 | Chivukula | G10L 19/0204 704/500 |
| 2010/0286805 | A1 | 11/2010 | Gao et al. | |
| 2010/0286990 | A1 * | 11/2010 | Biswas | G10L 19/035 704/500 |
| 2010/0324914 | A1 | 12/2010 | Stachurski et al. | |
| 2011/0002266 | A1 | 1/2011 | Gao | |
| 2011/0054911 | A1 * | 3/2011 | Baumgarte | G10L 19/24 704/500 |
| 2011/0099018 | A1 | 4/2011 | Neuendorf et al. | |
| 2011/0257984 | A1 * | 10/2011 | Virette | G10L 19/26 704/503 |
| 2012/0213385 | A1 * | 8/2012 | Liljeryd | G10L 21/038 381/94.3 |
| 2012/0275607 | A1 * | 11/2012 | Kjoerling | G10L 21/038 381/22 |

FOREIGN PATENT DOCUMENTS

| | | | |
|---|---|---|---|
| EP | 1926083 | A1 | 5/2008 |
| EP | 2019391 | A2 | 1/2009 |
| JP | 2003044097 | A | 2/2003 |
| JP | 2005338872 | A | 12/2005 |
| JP | 2007187905 | A | 7/2007 |
| JP | 2008096567 | A | 4/2008 |
| JP | 2008519308 | A | 6/2008 |
| JP | 2009229519 | A | 10/2009 |
| JP | 2009244886 | A | 10/2009 |
| JP | 2010020251 | A | 1/2010 |
| WO | 0045379 | A2 | 8/2000 |
| WO | 0122402 | A1 | 3/2001 |
| WO | 0241301 | A1 | 5/2002 |
| WO | 2004010415 | A1 | 1/2004 |
| WO | 2007000988 | A1 | 1/2007 |
| WO | 2007037361 | A1 | 4/2007 |
| WO | 2012017621 | A1 | 2/2012 |

OTHER PUBLICATIONS

G.729-based embedded variable bit-rate coder: An 8-32 kbit/s scalable wideband coder bitstream interoperable with G.729—Amendment 6—New Annex E on superwideband scalable extension. Mar. 2010.*

Sanjeev Mehrotra et al: "Hybrid low bitrate audio coding using adaptive gain shape vector quantization", 2008, total 6 pages.

Stanislaw Gorlow: "Frequency-domain bandwidth extension for low-delay audio coding applications", Jul. 2009, total 124 pages.

Shimada Osamu et al: "A Low Power SBR Algorithm for the MPEG-4 Audio Standard and its DSP Implementation", 2004, total 8 pages.

Guillaume Fuchs et al: "A new post-filtering for artificially replicated high-band in speech coders", May 2006, total 4 pages.

Juin-Hwey Chen et al:"Adaptive postfiltering for quality enhancement of coded speech", Jan. 1995, total 13 pages.

Per Ekstrand: "Bandwidth extension of audio signals by spectral band replication", Nov. 15, 2002, total 6 pages.

"Discussion and Link Level Simulation Results on LTE-A Downlink Multi-site MIMO Cooperation", 3GPP TSG-Ran Working Group 1 Meeting #55 Prague, Czech Republic, R1-084465, Nov. 10-14, 2008, total 11 pages.

"Analysis of CQI/PMI Feedback for Downlink CoMP", 3GPP TSG RAN WG1 meeting #56 Athens, Greece, Feb. 9-13, 2009, R1-090941, Feb. 9-13, 2009, total 4 pages.

"TP for feedback in support of DL CoMP for LTE-A TR", 3GPP TSG-RAN WG1 #57 San Francisco, CA. USA, R1-092290, May 4-8, 2009, total 4 pages.

(56) References Cited

OTHER PUBLICATIONS

Martin Dietz et al: "Spectral Band Replication, a novel approach in audio coding", May 2002, total 8 pages.
"Information technology—MPEG audio technologies—Part 3: Unified speech and audio coding", ISO/IEC 23003-3, Apr. 1, 2012, total 286 pages.
ISO/IEC JTC1/SC29/WG11, MPEG2010/N11299, 2009, total 18 pages.

* cited by examiner

Filter Band Encoder with SBR Side Information

Filter Bank Decoder with SBR, Spectrum Flatness Control and Optional Post-processing

SPECTRUM FLATNESS CONTROL FOR BANDWIDTH EXTENSION

CROSS-REFERENCE TO RELATED APPLICATIONS

This application is a continuation of U.S. patent application Ser. No. 13/185,163, filed on Jul. 18, 2011, which claims priority to U.S. Provisional Application No. 61/365,456 filed on Jul. 19, 2010, entitled "Spectrum Flatness Control for Bandwidth Extension," which application is incorporated by reference herein in its entirety.

TECHNICAL FIELD

The present invention relates generally to audio/speech processing, and more particularly to spectrum flatness control for bandwidth extension.

BACKGROUND

In modern audio/speech digital signal communication system, a digital signal is compressed at an encoder, and the compressed information or bitstream can be packetized and sent to a decoder frame by frame through a communication channel. The system of both encoder and decoder together is called codec. Speech/audio compression may be used to reduce the number of bits that represent speech/audio signal thereby reducing the bandwidth and/or bit rate needed for transmission. In general, a higher bit rate will result in higher audio quality, while a lower bit rate will result in lower audio quality.

Audio coding based on filter bank technology is widely used. In signal processing, a filter bank is an array of band-pass filters that separates the input signal into multiple components, each one carrying a single frequency subband of the original input signal. The process of decomposition performed by the filter bank is called analysis, and the output of filter bank analysis is referred to as a subband signal having as many subbands as there are filters in the filter bank. The reconstruction process is called filter bank synthesis. In digital signal processing, the term filter bank is also commonly applied to a bank of receivers, which also may down-convert the subbands to a low center frequency that can be re-sampled at a reduced rate. The same synthesized result can sometimes be also achieved by undersampling the bandpass subbands. The output of filter bank analysis may be in a form of complex coefficients; each complex coefficient having a real element and imaginary element respectively representing a cosine term and a sine term for each subband of filter bank.

(Filter-Bank Analysis and Filter-Bank Synthesis) is one kind of transformation pair that transforms a time domain signal into frequency domain coefficients and inverse-transforms frequency domain coefficients back into a time domain signal. Other popular transformation pairs, such as (FFT and iFFT), (DFT and iDFT), and (MDCT and iMDCT), may be also used in speech/audio coding.

In the application of filter banks for signal compression, some frequencies are perceptually more important than others. After decomposition, perceptually significant frequencies can be coded with a fine resolution, as small differences at these frequencies are perceptually noticeable to warrant using a coding scheme that preserves these differences. On the other hand, less perceptually significant frequencies are not replicated as precisely, therefore, a coarser coding scheme can be used, even though some of the finer details will be lost in the coding. A typical coarser coding scheme may be based on the concept of Bandwidth Extension (BWE), also known High Band Extension (HBE). One recently popular specific BWE or HBE approach is known as Sub Band Replica (SBR) or Spectral Band Replication (SBR). These techniques are similar in that they encode and decode some frequency sub-bands (usually high bands) with little or no bit rate budget, thereby yielding a significantly lower bit rate than a normal encoding/decoding approach. With the SBR technology, a spectral fine structure in high frequency band is copied from low frequency band, and random noise may be added. Next, a spectral envelope of the high frequency band is shaped by using side information transmitted from the encoder to the decoder. A specific SBR technology with several post-processing modules has recently been employed in the international standard named as MPEG4 USAC wherein MPEG means Moving Picture Experts Group and USAC indicates Unified Speech Audio Coding.

In some applications, post-processing or controlled post-processing at a decoder side is used to further improve the perceptual quality of signals coded by low bit rate coding or SBR coding. Sometimes, several post-processing or controlled post-processing modules are introduced in a SBR decoder.

SUMMARY OF THE INVENTION

In accordance with an embodiment, a method of decoding an encoded audio bitstream at a decoder includes receiving the audio bitstream, decoding a low band bitstream of the audio bitstream to get low band coefficients in a frequency domain, and copying a plurality of the low band coefficients to a high frequency band location to generate high band coefficients. The method further includes processing the high band coefficients to form processed high band coefficients. Processing includes modifying an energy envelope of the high band coefficients by multiplying modification gains to flatten or smooth the high band coefficients, and applying a received spectral envelope decoded from the received audio bitstream to the high band coefficients. The low band coefficients and the processed high band coefficients are then inverse-transformed to the time domain to obtain a time domain output signal.

In accordance with a further embodiment, a post-processing method of generating a decoded speech/audio signal at a decoder and improving spectrum flatness of a generated high frequency band includes generating high band coefficients from low band coefficients in a frequency domain using a Bandwidth Extension (BWE) high band coefficient generation method. The method also includes flattening or smoothing an energy envelope of the high band coefficients by multiplying flattening or smoothing gains to the high band coefficients, shaping and determining energies of the high band coefficients by using a BWE shaping and determining method, and inverse-transforming the low band coefficients and the high band coefficients to the time domain to obtain a time domain output speech/audio signal.

In accordance with a further embodiment, a system for receiving an encoded audio signal includes a low-band block configured to transform a low band portion of the encoded audio signal into frequency domain low band coefficients at an output of the low-band block. A high-band block is coupled to the output of the low-band block and is configured to generate high band coefficients at an output of the high band block by copying a plurality of the low band coefficients to high frequency band locations. The system also includes an envelope shaping block coupled to the output of the high-band block that produces shaped high band coefficients at an output of the envelope shaping block. The envelope shaping block is configured to modify an energy envelope of the high band coefficients by multiplying modification gains to flatten or smooth the high band coefficients, and apply a received spectral envelope decoded from the encoded audio signal to the high band coefficients. The system also includes an inverse transform block configured to produce a time domain audio output that is coupled to the output of envelope shaping block and to the output of the low band block.

In accordance with a further embodiment, a non-transitory computer readable medium has an executable program stored thereon. The program instructs a processor to perform the steps of decoding an encoded audio signal to produce a decoded audio signal and postprocessing the decoded audio signal with a spectrum flatness control for spectrum bandwidth extension. In an embodiment, the encoded audio signal includes a coded representation of an input audio signal.

The foregoing has outlined rather broadly the features of an embodiment of the present invention in order that the detailed description of the invention that follows may be better understood. Additional features and advantages of embodiments of the invention will be described hereinafter, which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

Figure 1A:
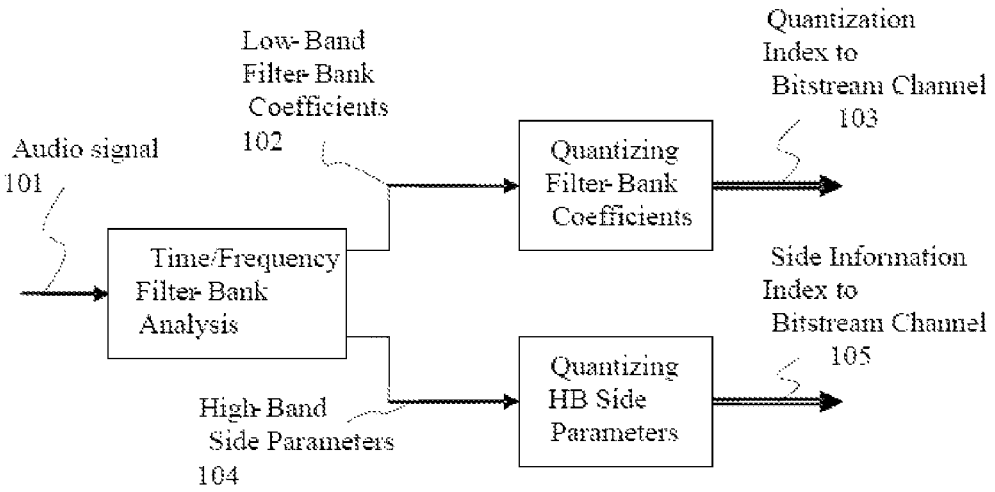
FIGS. 1*a-b* illustrate an embodiment encoder and decoder according to an embodiment of the present invention.

The making and using of the embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to various embodiments in a specific context, a system and method for audio coding and decoding. Embodiments of the invention may also be applied to other types of signal processing.

Embodiments of the present invention use a spectrum flatness control to improve SBR performance in audio decoders. The spectrum flatness control can be viewed as one of the post-processing or controlled post-processing technologies to further improve a low bit rate coding (such as SBR) of speech and audio signals. A codec with SBR technology uses more bits for coding the low frequency band than for the high frequency band, as one basic feature of SBR is that a fine spectral structure of high frequency band is simply copied from a low frequency band by spending few extra bits or even no extra bits. A spectral envelope of high frequency band, which determines the spectral energy distribution over the high frequency band, is normally coded with a very limited number of bits. Usually, the high frequency band is roughly divided into several subbands, and an energy for each subband is quantized and sent from an encoder to a decoder. The information to be coded with the SBR for the high frequency band is called side information, because the spent number of bits for the high frequency band is much smaller than a normal coding approach or much less significant than the low frequency band coding.

In an embodiment, the spectrum flatness control is implemented as a post-processing module that can be used in the decoder without spending any bits. For example post-processing may be performed at the decoder without using any information specifically transmitted from encoder for the post-processing module. In such an embodiment, a post-processing module is operated using only using available information at the decoder that was initially transmitted for purposes other than post-processing. In embodiments in which a controlling flag is used to control a spectrum flatness control module, information sent for the controlling flag from the encoder to the decoder is viewed as a part of the side information for the SBR. For example, one bit can be spent to switch on or off the spectrum flatness control module or to choose different spectrum flatness control module.

FIGS. 1*a-b* and 2*a-b* illustrate embodiment examples of an encoder and a decoder employing a SBR approach. These figures also show possible example embodiment locations of the spectrum flatness control application, however, the exact location of the spectrum flatness control depends on the detailed encoding/decoding scheme as explained below. FIG. 3, FIG. 4, FIG. 5, and FIG. 6 illustrate example spectra of embodiment systems.

FIG. 1*a*, illustrates an embodiment filter bank encoder. Original audio signal or speech signal 101 at the encoder is first transformed into a frequency domain by using a filter bank analysis or other transformation approach. Low-band filter bank output coefficients 102 of the transformation are quantized and transmitted to a decoder through a bitstream channel 103. High frequency band output coefficients 104 from the transformation are analyzed, and low bit rate side information for high frequency band is transmitted to the decoder through bitstream channel 105. In some embodiments, only the low rate side information is transmitted for the high frequency band.

Figure 1B:
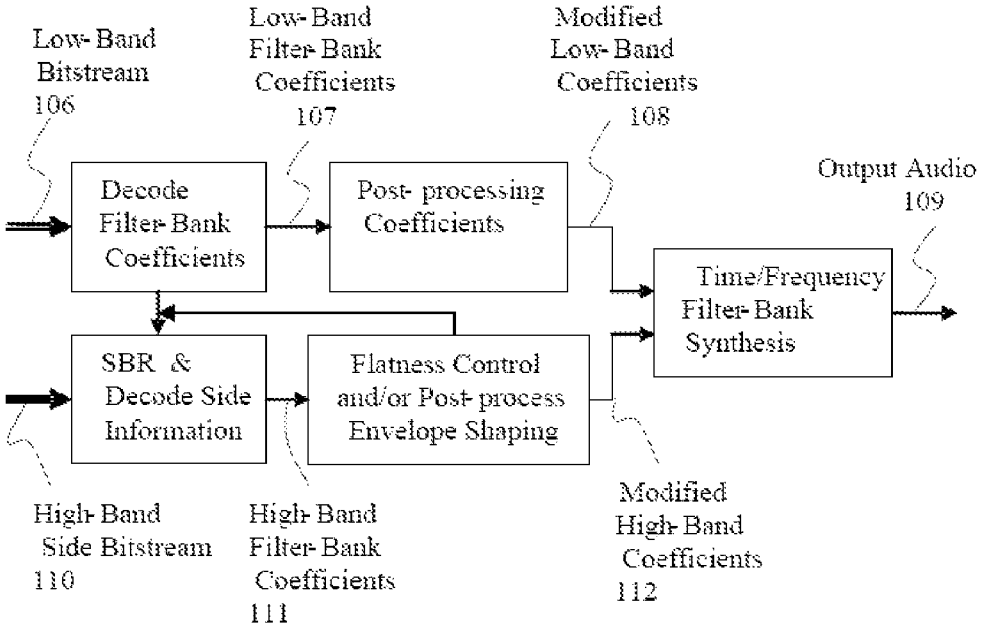

At the embodiment decoder shown in FIG. 1*b*, quantized filter bank coefficients 107 of the low frequency band are decoded by using the bitstream 106 from the transmission channel. Low band frequency domain coefficients 107 may be optionally post-processed to get post-processed coefficients 108, before performing an inverse transformation such as filter bank synthesis. The high band signal is decoded with a SBR technology, using side information to help the generation of high frequency band.

In an embodiment, the side information is decoded from bitstream 110, and frequency domain high band coefficients 111 or post-processed high band coefficients 112 are generated using several steps. The steps may include at least two basic steps: one step is to copy the low band frequency coefficients to a high band location, and other step is to shape the spectral envelope of the copied high band coefficients by using the received side information. In some embodiments, the spectrum flatness control may be applied to the high frequency band before or after the spectral envelope is applied; the spectrum flatness control may even be applied first to the low band coefficients. These post-processed low band coefficients are then copied to a high band location after applying the spectrum flatness control. In many embodiments, the spectrum flatness control may be placed in various locations in the signal chain. The most effective location of the spectrum flatness control depends, for example on the decoder structure and the precision of the received spectrum envelope. The high band and low band coefficients are finally combined together and inverse-transformed back to the time domain to obtain output audio signal 109.

Figure 2A:
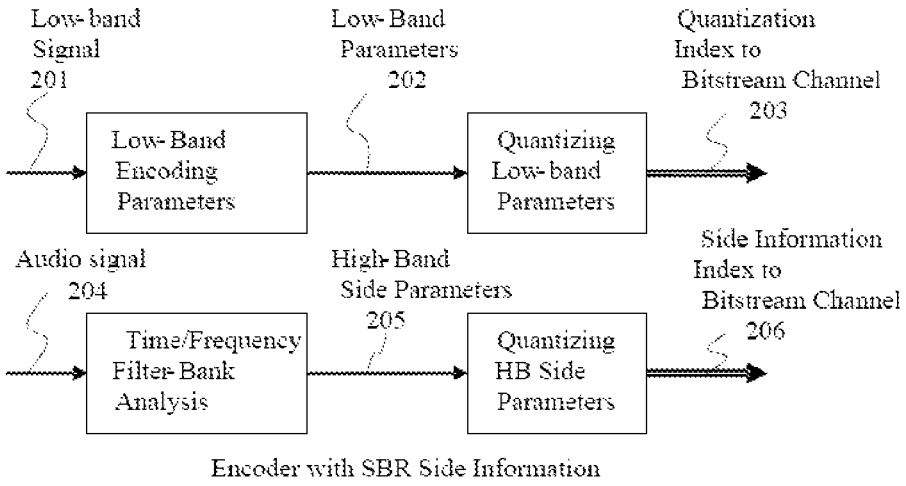
FIGS. 2*a-b* illustrate an embodiment encoder and decoder according to a further embodiment of the present invention.
Figure 2B:
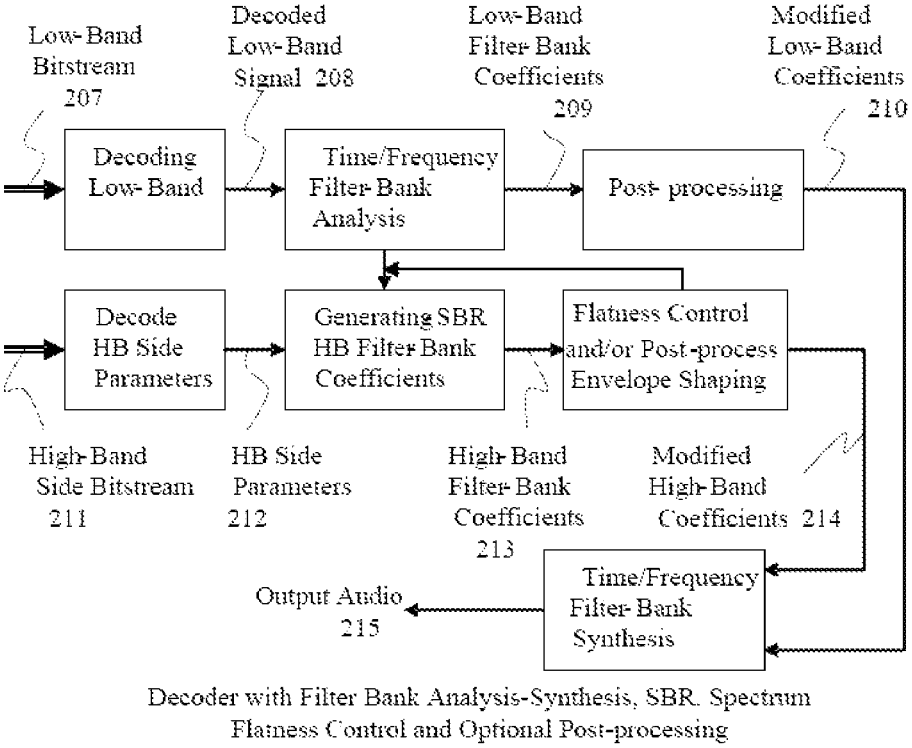

FIGS. 2*a* and 2*b* illustrate an embodiment encoder and decoder, respectively. In an embodiment, a low band signal is encoded/decoded with any coding scheme while a high band is encoded/decoded with a low bit rate SBR scheme. At the encoder of FIG. 2*a*, low band original signal 201 is analyzed by the low band encoder to obtain low band parameters 202, and the low band parameters are then quantized and transmitted from the encoder to the decoder through bitstream channel 203. Original signal 204 including the high band signal is transformed into a frequency domain by using filter bank analysis or other transformation tools. The output coefficients of high frequency band from the transformation are analyzed to obtain side parameters 205, which represent the high band side information.

In some embodiments, only the low bit rate side information for high frequency band is transmitted to the decoder through bitstream channel 206. At the decoder side of FIG. 2, low band signal 208 is decoded with received bitstream 207, and the low band signal is then transformed into a frequency domain by using a transformation tool such as filter bank analysis to obtain corresponding frequency coefficients 209. In some embodiments, these low band frequency domain coefficients 209 are optionally post-processed to get the post-processed coefficients 210 before going to an inverse transformation such as filter bank synthesis. The high band signal is decoded with a SBR technology, using side information to help the generation of high frequency band. The side information is decoded from bitstream 211 to obtain side parameters 212.

In an embodiment, frequency domain high band coefficients 213 or the post-processed high band coefficients 214 are generated by copying the low band frequency coefficients to a high band location, and shaping the spectral envelope of the copied high band coefficients by using the side parameters. The spectrum flatness control may be applied to the high frequency band before or after the received spectral envelope is applied; the spectrum flatness control can even be applied first to the low band coefficients. Next, these post-processed low band coefficients are copied to a high band location after applying the spectrum flatness control. In further embodiments, random noise is added to the high band coefficients. The high band and low band coefficients are finally combined together and inverse-transformed back to the time domain to obtain output audio signal 215.

FIG. 3, FIG. 4, FIG. 5, and FIG. 6 illustrate the spectral performance of embodiment spectrum flatness control systems and methods. Suppose that a low frequency band is encoded/decoded using a normal coding approach at a normal bit rate that may be much higher than a bit rate used to code the high band side information, and the high frequency band is generated by using a SBR approach. When the high band is wider than the low band, it possible that the low band may need to be repeatedly copied to the high band and then scaled.

Figure 3:
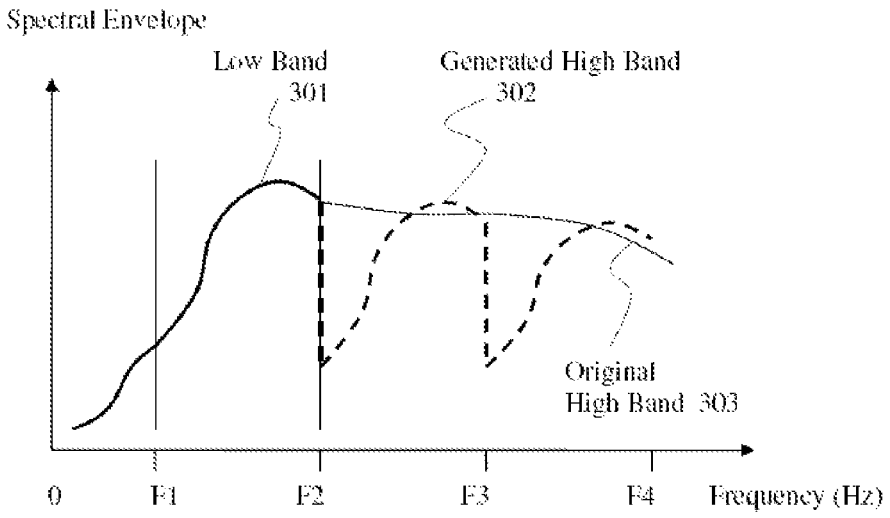
FIG. 3 illustrates a generated high band spectrum envelope using a SBR approach for unvoiced speech without using embodiment spectrum flatness control systems and methods.

FIG. 3 illustrates a spectrum representing unvoiced speech, in which the spectrum from [F1, F2] is copied to [F2, F3] and [F3, F4]. In some cases, if the low band 301 is not flat, but the original high band 303 is flat, repeatedly copying high band 302 may produce a distorted signal with respect to the original signal having original high band 303.

Figure 4:
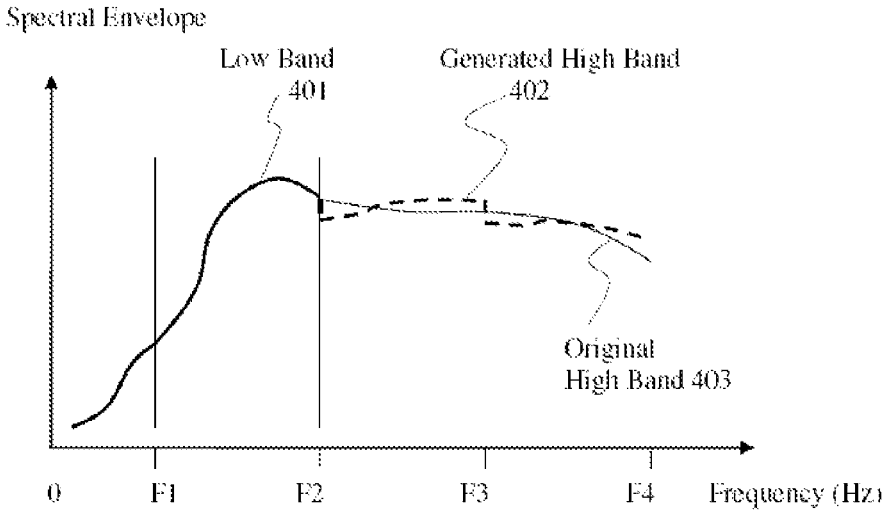
FIG. 4 illustrates a generated high band spectrum envelope using a SBR approach for unvoiced speech using embodiment spectrum flatness control systems and methods.

FIG. 4 illustrates a spectrum of a system in which embodiment flatness control is applied. As can be seen, low band 401 appears similar to low band 301 of FIG. 3, however, the repeatedly copied high band 402 now appears much closer to the original high band 403.

Figure 5:
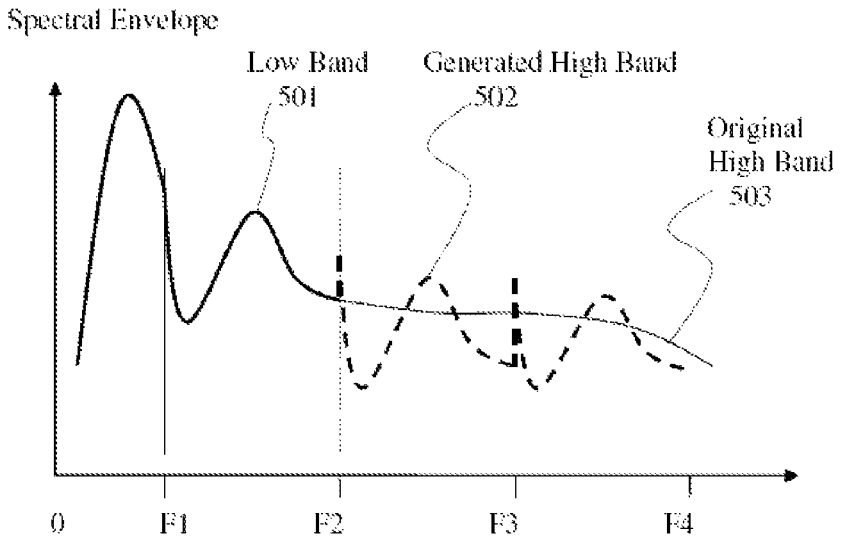
FIG. 5 illustrates a generated high band spectrum envelope using a SBR approach for typical voiced speech without using embodiment spectrum flatness control systems and methods.

FIG. 5 illustrates a spectrum representing voiced speech where the original high band area 503 is noisy and flat and the low band 501 is not flat. Repeatedly copied high band 502, however, is also not flat with respect to original high band 503.

Figure 6:
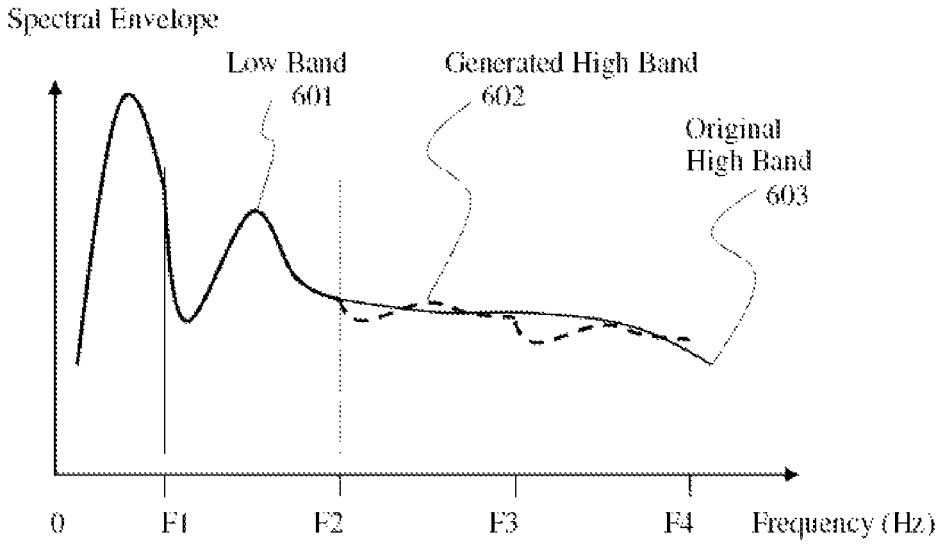
FIG. 6 illustrates a generated high band spectrum envelope using a SBR approach for voiced speech using embodiment spectrum flatness control systems and methods.

FIG. 6 illustrates a spectrum representing voiced speech in which embodiment spectral flatness control methods are applied. Here, low band 601 is the same as the low band 501, but the spectral shape of repeatedly copied high band 602 is now much closer to original high band 603.

There are a number of embodiment systems and methods that can be used to make the generated high band spectrum flatter by applying the spectrum flatness control post-processing. The following describes some of the possible ways, however, other alternative embodiments not explicitly described below are possible.

In one embodiment, spectrum flatness control parameters are estimated by analyzing low band coefficients to be copied to a high frequency band location. Spectrum flatness control parameters may also be estimated by analyzing high band coefficients copied from low band coefficients. Alternatively, spectrum flatness control parameters may be estimated using other methods.

In an embodiment, spectrum flatness control is applied to high band coefficients copied from low band coefficients. Alternatively, spectrum flatness control may be applied to high band coefficients before the high frequency band is shaped by applying a received spectral envelope decoded from side information. Furthermore, spectrum flatness control may also be applied to high band coefficients after the high frequency band is shaped by applying a received spectral envelope decoded from side information. Alternatively, spectrum flatness control may be applied in other ways.

In some embodiments, the spectrum flatness control has the same parameters for different classes of signals; while in other embodiments, spectrum flatness control does not keep the same parameters for different classes of signals. In some embodiments, spectrum flatness control is switched on or off, based on a received flag from an encoder and/or based on signal classes available at a decoder. Other conditions may also be used as a basis for switching on and off spectrum flatness control.

In some embodiments, spectrum flatness control is not switchable and the same controlling parameters are kept all the time. In other embodiments, spectrum flatness control is not switchable while making the controlling parameters adaptive to the available information at a decoder side.

In embodiments spectrum flatness control may be achieved using a number of methods. For example, in one embodiment, spectrum flatness control is achieved by smoothing a spectrum envelope of the frequency coefficients to be copied to a high frequency band location. Spectrum flatness control may also be achieved by smoothing a spectrum envelope of high band coefficients copied from a low frequency band, or by making a spectrum envelope of high band coefficients copied from a low frequency band closer to a constant average value before a received spectral envelope is applied. Furthermore, other methods may be used.

In an embodiment, 1 bit per frame is used to transmit classification information from an encoder to a decoder. This classification will tell the decoder if strong or weak spectrum flatness control is needed. Classification information may also be used to switch on or off the spectrum flatness control at the decoder in some embodiments.

In an embodiment, spectrum flatness improvement uses the following two basic steps: (1) an approach to identify signal frames where a copied high band spectrum should be flattened if a SBR is used; and (2) a low cost way to flatten the high band spectrum at the decoder for the identified frames. In some embodiments, not all signal frames may need the spectrum flatness improvement of the copied high band. In fact, for some frames, it may be better not to further flatten the high band spectrum because such an operation may introduce audible distortion. For example, the spectrum flatness improvement may be needed for speech signals, but may not be needed for music signal. In some embodiments, spectrum flatness improvement is applied for speech frames in which the original high band spectrum is noise-like or flat, does not contain any strong spectrum peaks.

The following embodiment algorithm example identifies frames having noisy and flat high band spectrum. This algorithm may be applied, for example to MPEG-4 USAC technology.

Suppose this algorithm example is based on FIG. 2, and the Filter-Bank complex coefficients output from Filter Bank Analysis for a long frame of 2048 digital samples (also called super-frame) at the encoder are:

$$\{Sr_enc[i][k], Si_enc[i][k]\},\ i=0,1,2,\ldots,31;\ k=0,1,2,\ldots,63 \tag{1}$$

where i is the time index that represents a 2.22 ms step at the sampling rate of 28800 Hz; and k is the frequency index indicating 225 Hz step for 64 small subbands from 0 to 14400 Hz.

The time-frequency energy array for one super-frame can be expressed as:

$$TF_energy_enc[i][k]=(Sr_enc[i][k])^2+(Si_enc[i][k])^2,\ i=0,1,2,\ldots,31;\ k=0,1,\ldots,63. \tag{2}$$

For simplicity, the energies in (2) are expressed in Linear domain and may be also represented in dB domain by using the well-known equation, Energy_dB=10 log(Energy), to transform Energy in Linear domain to Energy_dB in dB domain. In an embodiment, the average frequency direction energy distribution for one super-frame can be noted as:

$$\text{F_energy_enc}[k] = \frac{1}{32}\sum_{i=0}^{31}\text{TF_energy_enc}[i][k],\quad k = 0, 1, \ldots, 63. \tag{3}$$

In an embodiment, a parameter called Spectrum_Shapness is estimated and used to detect flat high band in the following way. Suppose Start_HB is the starting point to define the boundary between the low band and the high band, Spectrum_Shapness is the average value of several spectrum sharpness parameters evaluated on each subband of the high band:

$$\text{Spectrum_Sharpness} = \frac{1}{\text{K_sub}}\sum_{j=0}^{K_sub-1}\text{Sharpness_sub}(j) \tag{4}$$

where $$\text{Sharpness_sub}(j) = \frac{MeanEnergy(j)}{MaxEnergy(j)},\quad j = 0, 1, \ldots, \text{K_sub} - 1 \tag{5}$$

where $$MeanEnergy(j) = \frac{1}{\text{L_sub}}\sum_{k=0}^{L_sub-1}\text{F_energy_enc}(k + \text{Start_HB} + j\cdot\text{L_sub})$$

$$MaxEnergy(j) = \text{Max}\{\text{F_energy_enc}(k + \text{Start_HB} + j\cdot\text{L_sub}),\ k = 0, 1, \text{L_sub} - 1\}$$

where Start_HB, L_sub, and K_sub are constant numbers. In one embodiment, example values are be Start_HB=30, L_sub=3, and K_sub=11. Alternatively, other value may be used.

Another parameter used to help the flat high band detection is an energy ratio that represents the spectrum tilt:

$$\text{tilt_energy_ratio} = \frac{\text{h_energy}}{\text{l_energy}} \tag{6}$$

where $$\text{l_energy} = \frac{1}{L1}\sum_{k=0}^{L1-1}F - \text{energy_enc}(k) \tag{7}$$

$$\text{h_energy} = \frac{1}{(L3 - L2)}\sum_{k=L2}^{L3-1}\text{F_energy_enc}(k) \tag{8}$$

L1, L2, and L3 are constants. In one embodiment, their example values are L1=8, L2=16, and L3=24. Alternatively, other values may be used. If flat_flag=1 indicates a flat high band and flat_flag=0 indicates a non-flat high band, the flat indication flag is initialized to flat_flag=0. A decision is then made for each super-frame in the following way:

```
if (tilt_energy_ratio>THRD0) {
   if (Spectrum_Shapness>THRD1) flat_flag=1;
   if (Spectrum_Shapness<THRD2) flat_flag=0;
}
else {
   if (Spectrum_Shapness>THRD3) flat_flag=1;
   if (Spectrum_Shapness<THRD4) flat_flag=0;
}
```

where THRD0, THRD1, THRD2, THRD3, and THRD4 are constants. In one embodiment, example values are THRD0=32, THRD1=0.64, THRD2=0.62, THRD3=0.72, and THRD4=0.70. Alternatively, other values may be used. After flat_flag is determined at the encoder, only 1 bit per super-frame is needed to transmit the spectrum flatness flag to the decoder in some embodiments. If a music/speech classification already exists, the spectrum flatness flag can also be simply set to be equal to the music/speech decision.

At the decoder side, the high band spectrum is made flatter if the received flat_flag for the current super-frame is 1. Suppose the Filter-Bank complex coefficients for a long frame of 2048 digital samples (also called super-frame) at the decoder are:

$$\{Sr_dec[i][k], Si_dec[i][k]\},\ i=0,1,2,\ldots,31;\quad k=0,1,2,\ldots,63. \tag{9}$$

where i is the time index which represents 2.22 ms step at the sampling rate of 28800 Hz; k is the frequency index indicating 225 Hz step for 64 small subbands from 0 to 14400 Hz. Alternatively, other values may be used for the time index and sampling rate.

Similar to the encoder, Start_HB is the starting point of the high band, defining the boundary between the low band and the high band. The low band coefficients in (9) from k=0 to k=Start_HB−1 are obtained by directly decoding a low band bitstream or transforming a decoded low band signal into a frequency domain. If a SBR technology is used, the high band coefficients in (9) from k=Start_HB to k=63 are obtained first by copying some of the low band coefficients in (9) to the high band location, and then post-processed, smoothed (flattened), and/or shaped by applying a received spectral envelope decoded from a side information. The smoothing or flattening of the high band coefficients happens before applying the received spectral envelope in some embodiments. Alternatively, it may also be done after applying the received spectral envelope.

Similar to the encoder, the time-frequency energy array for one super-frame at the decoder can be expressed as, $$TF_energy_dec[i][k]=(Sr_dec[i][k])^2+(Si_dec[i][k])^2,\quad i=0,1,2,\ldots,31;\ k=0,1,\ldots,63. \tag{10}$$

If the smoothing or flattening of the high band coefficients happens before applying the received spectral envelope, the energy array in (10) from k=Start_HB to k=63 represents the energy distribution of the high band coefficients before applying the received spectral envelope. For the simplicity, the energies in (10) are expressed in Linear domain, although they can be also represented in dB domain by using the well-known equation, Energy_dB=10 log(Energy), to transform Energy in Linear domain to Energy_dB in dB domain. The average frequency direction energy distribution for one super-frame can be noted as, $$\text{F_energy_dec}[k] = \frac{1}{32}\sum_{i=0}^{31}\text{TF_energy_dec}[i][k],\quad k = 0, 1, \ldots, 63. \tag{11}$$

An average (mean) energy parameter for the high band is defined as:

$$\text{Mean_HB} = \frac{1}{(\text{End_HB} - \text{Start_HB})}\sum_{k=Start_HB}^{End_HB-1}\text{F_energy_dec}[k] \tag{12}$$

The following modification gains to make the high band flatter are estimated and applied to the high band Filter Bank coefficients, where the modification gains are also called flattening (or smoothing) gains,

```
if (flat_flag==1) {
   for (k=Start_HB,....,End_HB-1) {
      Gain(k) = (   C0+C1·√Mean_HB/F_energy_dec[k]   ) ;
      for (i=0,1,2,...,31) {
         Sr_dec[i][k] ⇐ Sr_dec[i][k]·Gain(k) ;
         Si_dec[i][k] ⇐ Si_dec[i][k]·Gain(k) ;
      }
   }
}
```

flat_flag is a classification flag to switch on or off the spectrum flatness control. This flag can be transmitted from an encoder to a decoder, and may represent a speech/music classification or a decision based on available information at the decoder; Gain(k) are the flattening (or smoothing) gains; Start_HB, End_HB, C0 and C1 are constants. In one embodiment, example values are Start_HB=30, End_HB=64, C0=0.5 and C1=0.5. Alternatively, other values may be used. C0 and C1 meet the condition that C0+C1=1. A larger C1 means that a more aggressive spectrum modification is used and the spectrum energy distribution is made to be closer to the average spectrum energy, so that the spectrum becomes flatter. In embodiments, the value setting of C0 and C1 depends on the bit rate, the sampling rate and the high frequency band location. In some embodiments, a larger C1 can be chosen when the high band is located in a higher frequency range and a smaller C1 is for the high band located relatively in a lower frequency range.

It should be appreciated that the above example is just one of the ways to smooth or flatten the copied high band spectrum envelope. Many other ways are possible, such as using a mathematical data smoothing algorithm named Polynomial Curve Fitting to estimate the flattening (or smoothing) gains. All the low band and high band Filter-Bank coefficients are finally input to Filter-Bank Synthesis which outputs an audio/speech digital signal.

In some embodiments, a post-processing method for controlling spectral flatness of a generated high frequency band is used. The spectral flatness controlling method may include several steps including decoding a low band bitstream to get a low band signal, and transforming the low band signal into a frequency domain to obtain low band coefficients {Sr_dec[i][k],Si_dec[i][k]}, k=0, . . . ,Start_HB−1. Some of these low band coefficients are copied to a high frequency band location to generate high band coefficients {Sr_dec[i][k],Si_dec[i][k]}, k=Start_HB, . . . End_HB−1. An energy envelope of the high band coefficients is flattened or smoothed by multiplying flattening or smoothing gains {Gain(k)} to the high band coefficients.

In an embodiment, the flattening or smoothing gains are evaluated by analyzing, examining, using and flattening or smoothing the high band coefficients copied from the low band coefficients or an energy distribution {F_energy_dec[k]} of the low band coefficients to be copied to the high band location. One of the parameters to evaluate the flattening (or smoothing) gains is a mean energy value (Mean_HB) obtained by averaging the energies of the high band coefficients or the energies of the low band coefficients to be copied. The flattening or smoothing gains may be switchable or variable, according to a spectrum flatness classification (flat_flag) transmitted from an encoder to a decoder. The classification is determined at the encoder by using a plurality of Spectrum Sharpness parameters where each Spectrum Sharpness parameter is defined by dividing a mean energy (MeanEnergy(j)) by a maximum energy (MaxEnergy(j)) on a sub-band j of an original high frequency band.

In an embodiment, the classification may be also based on a speech/music decision. A received spectral envelope, decoded from a received bitstream, may also be applied to further shape the high band coefficients. Finally, the low band coefficients and the high band coefficients are inverse-transformed back to time domain to obtain a time domain output speech/audio signal.

In some embodiments, the high band coefficients are generated with a Bandwidth Extension (BWE) or a Spectral Band Replication (SBR) technology; then, the spectral flatness controlling method is applied to the generated high band coefficients.

In other embodiments, the low band coefficients are directly decoded from a low band bitstream; then, the spectral flatness controlling method is applied to the high band coefficients which are copied from some of the low band coefficients.

Figure 7:
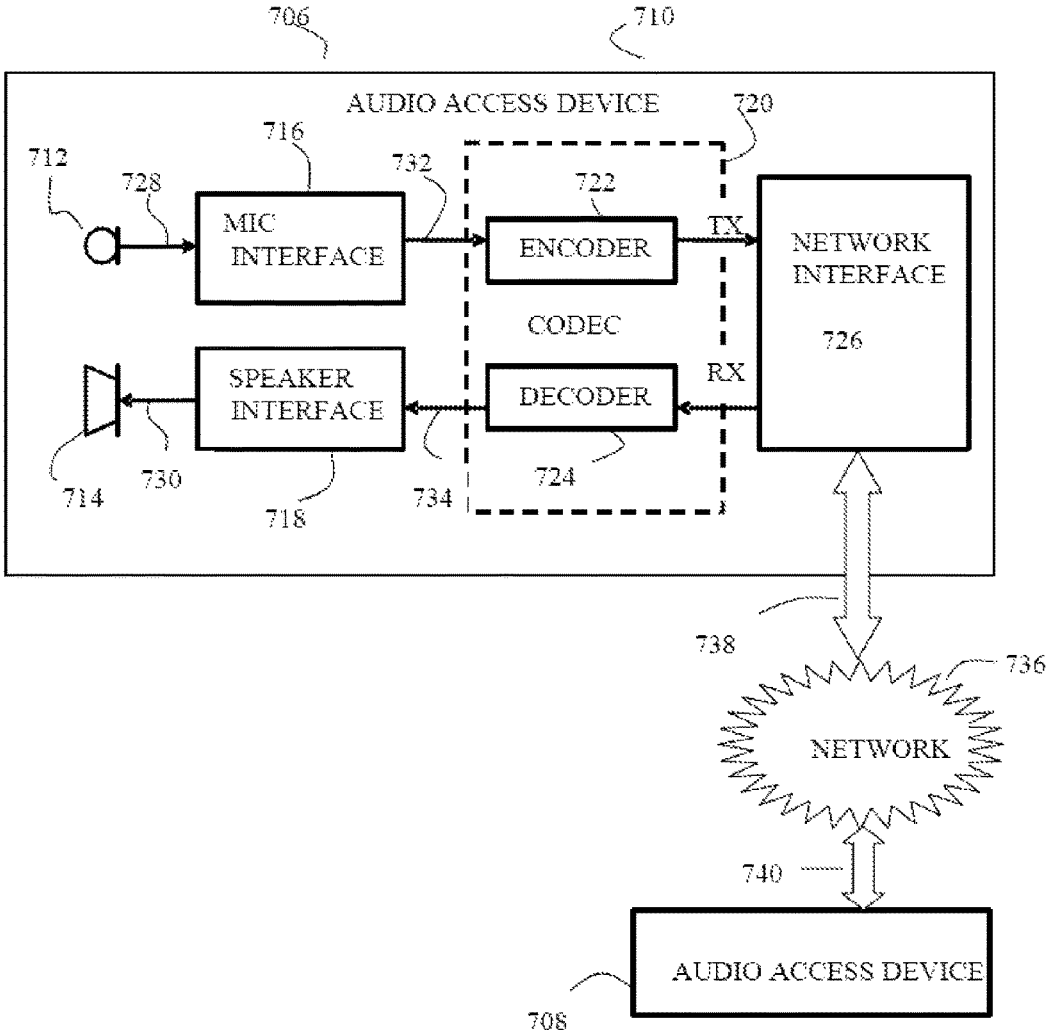
FIG. 7 illustrates a communication system according to an embodiment of the present invention.

FIG. 7 illustrates communication system 710 according to an embodiment of the present invention. Communication system 710 has audio access devices 706 and 708 coupled to network 736 via communication links 738 and 740. In one embodiment, audio access device 706 and 708 are voice over internet protocol (VOIP) devices and network 736 is a wide area network (WAN), public switched telephone network (PSTN) and/or the internet. In another embodiment, audio access device 706 is a receiving audio device and audio access device 708 is a transmitting audio device that transmits broadcast quality, high fidelity audio data, streaming audio data, and/or audio that accompanies video programming. Communication links 738 and 740 are wireline and/or wireless broadband connections. In an alternative embodiment, audio access devices 706 and 708 are cellular or mobile telephones, links 738 and 740 are wireless mobile telephone channels and network 736 represents a mobile telephone network. Audio access device 706 uses microphone 712 to convert sound, such as music or a person's voice into analog audio input signal 728. Microphone interface 716 converts analog audio input signal 728 into digital audio signal 732 for input into encoder 722 of CODEC 720. Encoder 722 produces encoded audio signal TX for transmission to network 726 via network interface 726 according to embodiments of the present invention. Decoder 724 within CODEC 720 receives encoded audio signal RX from network 736 via network interface 726, and converts encoded audio signal RX into digital audio signal 734. Speaker interface 718 converts digital audio signal 734 into audio signal 730 suitable for driving loudspeaker 714.

In embodiments of the present invention, where audio access device 706 is a VOIP device, some or all of the components within audio access device 706 can be implemented within a handset. In some embodiments, however, Microphone 712 and loudspeaker 714 are separate units, and microphone interface 716, speaker interface 718, CODEC 720 and network interface 726 are implemented within a personal computer. CODEC 720 can be implemented in either software running on a computer or a dedicated processor, or by dedicated hardware, for example, on an application specific integrated circuit (ASIC). Microphone interface 716 is implemented by an analog-to-digital (A/D) converter, as well as other interface circuitry located within the handset and/or within the computer. Likewise, speaker interface 718 is implemented by a digital-to-analog converter and other interface circuitry located within the handset and/or within the computer. In further embodiments, audio access device 706 can be implemented and partitioned in other ways known in the art.

In embodiments of the present invention where audio access device 706 is a cellular or mobile telephone, the elements within audio access device 706 are implemented within a cellular handset. CODEC 720 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 722 or decoder 724, for example, in a digital microphone system or music playback device. In other embodiments of the present invention, CODEC 720 can be used without microphone 712 and speaker 714, for example, in cellular base stations that access the PSTN.

Figure 8:
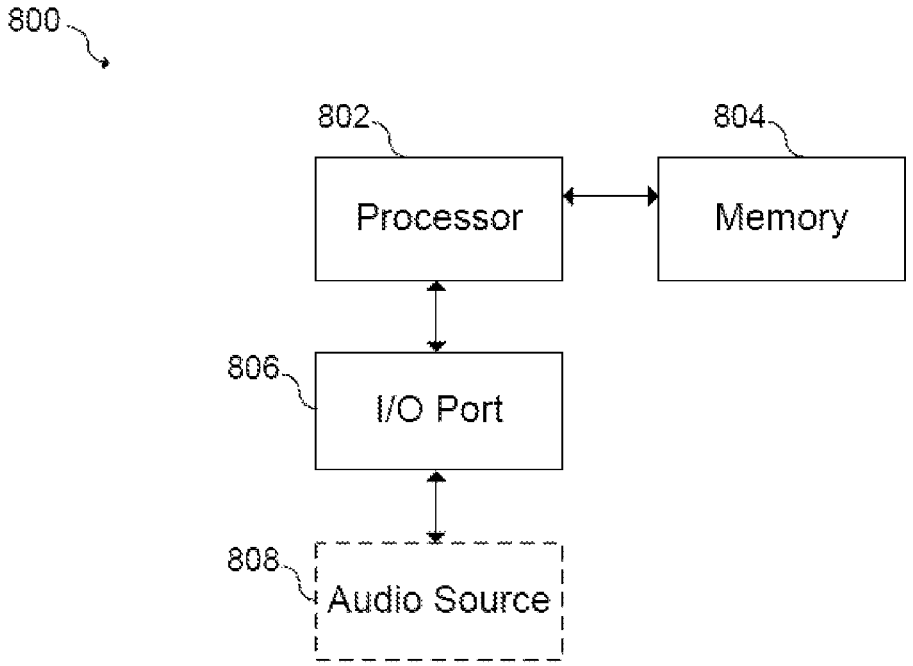
FIG. 8 illustrates a processing system that can be utilized to implement methods of the present invention.

FIG. 8 illustrates a processing system 800 that can be utilized to implement methods of the present invention. In this case, the main processing is performed in processor 802, which can be a microprocessor, digital signal processor or any other appropriate processing device. In some embodiments, processor 802 can be implemented using multiple processors. Program code (e.g., the code implementing the algorithms disclosed above) and data can be stored in memory 804. Memory 8404 can be local memory such as DRAM or mass storage such as a hard drive, optical drive or other storage (which may be local or remote). While the memory is illustrated functionally with a single block, it is understood that one or more hardware blocks can be used to implement this function.

In one embodiment, processor 802 can be used to implement various ones (or all) of the units shown in FIGS. 1*a-b* and 2*a-b*. For example, the processor can serve as a specific functional unit at different times to implement the subtasks involved in performing the techniques of the present invention. Alternatively, different hardware blocks (e.g., the same as or different than the processor) can be used to perform different functions. In other embodiments, some subtasks are performed by processor 802 while others are performed using a separate circuitry.

FIG. 8 also illustrates an I/O port 806, which can be used to provide the audio and/or bitstream data to and from the processor. Audio source 408 (the destination is not explicitly shown) is illustrated in dashed lines to indicate that it is not necessary part of the system. For example, the source can be linked to the system by a network such as the Internet or by local interfaces (e.g., a USB or LAN interface).

Advantages of embodiments include improvement of subjective received sound quality at low bit rates with low cost.

Although the embodiments and their advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method of decoding an encoded audio bitstream at a decoder, the method comprising:

receiving, by a processor in the decoder, the audio bitstream from the network, the audio bitstream comprising a low band bitstream;

decoding, by the processor in the decoder, the low band bitstream to get low band coefficients in a frequency domain;

copying, by the processor in the decoder, a plurality of the low band coefficients to a high frequency band location to generate high band coefficients;

evaluating, by the processor in the decoder, modification gains through following equation:

$$\mathrm{Gain}(k)=(C0+C1\cdot\sqrt{\mathrm{Mean_}HB/F_\mathrm{energy_}dec[k]}),\quad k=\mathrm{Start_}HB,\ldots,\mathrm{End_}HB-1,$$

wherein {Gain(k), k=Start_HB, . . . , End_HB−1} are the modification gains, F_energy_dec[k] is an energy distribution at each frequency location index k of a copied high band, Start_HB and End_HB define a high band range, C0 and C1 satisfying C0+C1=1 are pre-determined constants, and Mean_HB is a mean energy value obtained by averaging energies of the high band coefficients;

modifying, by the processor in the decoder, an energy envelope of the high band coefficients to flatten and smooth the high band coefficients by multiplying modification gains with the high band coefficients in the frequency domain to form processed high band coefficients, wherein the processed high band coefficients have an energy closer to the mean energy value;

applying, by the processor in the decoder, a received spectral envelope to the high band coefficients, the received spectral envelope being decoded from the received audio bitstream; and inverse-transforming, by the processor in the decoder, the low band coefficients and the processed high band coefficients to a time domain to obtain a time domain audio output signal.

2. The method of claim 1, wherein:

the received bitstream comprises a high-band side bitstream; and the method further comprises decoding the high-band side bitstream to get side information, and using Spectral Band Replication (SBR) techniques to generate the high band with the side information.

3. The method of claim 1, wherein the modification gains are switchable or variable according to a spectrum flatness classification received by the decoder from an encoder.

4. The method of claim 3, further comprising determining the spectrum flatness classification is based on a plurality of spectrum sharpness parameters, each of the plurality of spectrum sharpness parameter being defined by dividing a mean energy by a maximum energy on a sub-band of an original high frequency band.

5. The method of claim 3, wherein the classification is based on a speech/music decision.

6. The method of claim 1, wherein decoding the low band bitstream comprises:

decoding the low band bitstream to get a low band signal; and transforming the low band signal into the frequency domain to obtain the low band coefficients.

7. The method of claim 1, wherein modifying the energy envelope comprises flattening or smoothing the energy envelope.

8. A post-processing method of generating a decoded speech/audio signal at a decoder and improving spectrum flatness of a generated high frequency band, the method comprising:

generating, by a processor in the decoder, high band coefficients from low band coefficients in a frequency domain using a BandWidth Extension (BWE) high band coefficient generation method;

flattening and smoothing, by the processor in the decoder, an energy envelope of the high band coefficients in the frequency domain by multiplying flattening and smoothing gains to the high band coefficients, wherein the flattening and smoothing gains are used to generate an energy of modified high band coefficients being closer to a mean energy value obtained by averaging energies of the high band coefficients, and wherein each of the flattening and smoothing gains is individually calculated by the processor in the decoder based on the mean energy value and a value of a corresponding one of the high band coefficients;

shaping and determining, by the processor in the decoder, the energies of the high band coefficients by using a BWE shaping and determining method; and inverse-transforming, by the processor in the decoder, the low band coefficients and the high band coefficients to a time domain to obtain a time domain output speech/audio signal.

9. The method of claim 8, further comprising evaluating the flattening and smoothing gains by analyzing, examining, using and flattening and smoothing the high band coefficients or the low band coefficients to be copied to a high band location.

10. The method of claim 9, wherein the flattening and smoothing gains are switchable or variable according to a spectrum flatness classification transmitted from an encoder to the decoder.

11. The method of claim 10, wherein the classification is based on a speech/music decision.

12. The method of claim 8, wherein:

the BWE high band coefficient generation method comprises a Spectral Band Replication (SBR) high band coefficient generation method; and the BWE shaping and determining method comprises a SBR shaping and determining method.

13. A system for receiving an encoded audio signal, comprising:

a memory storage comprising instructions; and one or more processors in communication with the memory, wherein the one or more processors execute the instructions to:

transform a low band portion of the encoded audio signal into frequency domain low band coefficients at an output of a low-band block;

generate high band coefficients by copying a plurality of the low band coefficients to a high frequency band location;

evaluate modification gains through following equation:

$$\mathrm{Gain}(k)=(C0+C1\cdot\sqrt{\mathrm{Mean}_HB/F_\mathrm{energy}_dec[k]}),$$
$$k=\mathrm{Start}_HB,\ldots,\mathrm{End}_HB-1,$$

wherein {Gain(k), k=Start_HB, . . . , End_HB−1} are the modification gains, F_energy_dec[k] is an energy distribution at each frequency location index k of a copied high band, Start_HB and End_HB define a high band range, C0 and C1 satisfying C0+C1=1 are pre-determined constants, and Mean_HB is a mean energy value obtained by averaging energies of the high band coefficients;

generate shaped high band coefficients by multiplying the modification gains with the high band coefficients in the frequency domain to form processed high band coefficients, wherein the processed high band coefficients have an energy closer to the mean energy value, and apply a received spectral envelope to the high band coefficients, the received spectral envelope being decoded from the encoded audio signal; and produce a time domain audio output signal.

14. The system of claim 13, wherein the one or more processors further execute the instructions to produce the received spectral envelope from a high band side bitstream of the encoded audio signal.

15. The system of claim 13, wherein the one or more processors further execute the instructions to:

decode a low band bitstream of the encoded audio signal into a decoded low band signal; and produce the frequency domain low band coefficients from the decoded low band signal.

16. The system of claim 13, wherein the one or more processors further execute the instructions to evaluate the modification gains by analyzing, examining, using and modifying the high band coefficients or the low band coefficients to be copied to a high band location.

* * * * *